United States Patent [19]

Takeda

[11] 4,240,390

[45] Dec. 23, 1980

[54] AIR-FUEL RATIO CONTROL SYSTEM IN INTERNAL COMBUSTION ENGINE

[75] Inventor: Keiso Takeda, Shizuoka, Japan

[73] Assignee: Toyota Jidosha Kogyo Kabushiki Kaisha, Toyota, Japan

[21] Appl. No.: 63,395

[22] Filed: Aug. 3, 1979

[30] Foreign Application Priority Data

Sep. 1, 1978 [JP] Japan ..... 53-107726

[51] Int. Cl.[3] ..... F02B 3/00

[52] U.S. Cl. ..... 123/480; 123/440

[58] Field of Search ..... 123/119 CC, 32 AE, 127, 123/32 EB

[56] References Cited

U.S. PATENT DOCUMENTS 4,169,441 10/1979 Hirano ..... 123/119 EC

*Primary Examiner*—Ronald B. Cox

*Attorney, Agent, or Firm*—Cushman, Darby & Cushman

[57] ABSTRACT

An air-fuel ratio control system for an internal combustion engine which includes a carburetor in which the air-fuel ratio is set on the lean side rather than at a controlled air-fuel ratio. Fuel injection valves are provided for injecting additional fuel so that the air-fuel ratio is controlled to a correct value. A control circuit is provided for basically controlling the fuel injection rate in accordance with the RPM of the engine and the air intake pressure. The control circuit also corrects and controls the fuel injection rate in accordance with transient operating conditions of the engine.

9 Claims, 9 Drawing Figures

AIR-FUEL RATIO CONTROL SYSTEM IN INTERNAL COMBUSTION ENGINE

Japanese Patent Application No. 53-107726, filed Sept. 1, 1978 and as to which priority is claimed, is hereby incorporated by reference.

FIELD OF THE INVENTION

The present invention relates to an air-fuel ratio control system in an internal combustion engine, and particularly to an air-fuel ratio control system in an internal combustion engine of emission control type suitable for a motor car, and capable of controlling the air-fuel ratio of the engine at a constant given value throughout all of the operating conditions of the engine.

BACKGROUND

In general, in order to use the so-called three-way catalytic converter for simultaneously treating HC, CO and $NO_x$ that are noxious contents in the exhaust gas in an internal combustion engine, it is necessary to control the air-fuel ratio of the engine to a given value with high accuracy throughout all of the operating conditions of the engine. Consequently, with the air-fuel ratio control system in an internal combustion engine using a conventional carburetor, air-fuel ratio control is effected as follows. The air-fuel ratio control is effected by the carburetor during normal operating condition, and fuel is fed to the air intake system by use of a mechanical accelerator pump or negative pressure detecting and operating accelerator pump during acceleration. The air-fuel ratio is maintained within a given range by controlling the open-close speed of the throttle valve or the amount of secondary air fed to the air-intake system during deceleration.

With the air-fuel ratio control system in an internal combustion engine using a conventional carburetor of the type described above, for example, an auxiliary amount of fuel is adapted to be fed to the air intake system by use of the mechanical accelerator pump, negative pressure detecting and operating accelerator pump or the like during acceleration. However, the response is poor and the required supplementary amount of fuel corresponding to the change in the operating condition of the engine cannot be supplied. Hence, the fluctuation in the air-fuel ratio is high, resulting in a temporary lean air-fuel ratio. On the other hand, the air-fuel ratio is controlled by controlling the open-close speed of the throttle valve or the amount of secondary air fed to the air intake system during deceleration. The response here is also poor, and hence the fluctuation in the air-fuel ratio is high in the same manner as during acceleration, resulting in a temporary rich air-fuel ratio. Consequently, in the case of an exhaust gas purifying system using the three-way catalytic converter of the type described above, there has been encountered disadvantages in that it is very difficult to simultaneously treat HC, CO and $NO_x$ at a high purification rate because the carburetor cannot satisfactorily feed-back control to the theoretical air-fuel ratio.

As another type of conventional air-fuel ratio control system in internal combustion engines for motor cars, there have been used the so-called electronically controlled fuel injection system. In this, fuel injection valves are provided on respective cylinders of the engine and fuel is fed to the air intake system of the internal combustion engine by electrically or mechanically opening and closing the fuel injection valves for control without the use of a carburetor. Even in an engine with such an electronically controlled fuel injection system, the air-fuel ratio of the engine is sometimes shifted from the controlled air-fuel ratio due to delay in the air intake system and fuel system during acceleration or deceleration of the engine. Namely, during sharp acceleration of the engine, negative pressure in an air intake manifold sharply increases to atmospheric pressure, and hence, only part of the fuel injected into the air intake manifold is evaporated. This causes the amount of fuel sucked into the cylinders of the engine to decrease, resulting in a lean air-fuel ratio. On the other hand, during sharp deceleration of the engine, pressure in the air intake manifold decreases to almost vacuum pressure, whereby liquid fuel in the air intake manifold is evaporated in a large amount. This results in a rich air-fuel ratio.

In such an engine with an electrically controlled fuel injection system, in order to cope with the delay in both the air intake system and the fuel system, for example, the accelerating or decelerating condition of the engine is detected by differentiating the air intake pressure or the opening degree of the throttle. When the value of differentiation is higher than a given value, i.e. the transient variation value becomes larger to a certain extent, fuel is increased or decreased commensurate to the transient valuation value so as to correct the air-fuel ratio. Alternatively, until the transient variation value reaches a peak value during acceleration or deceleration of the engine, the value commensurate with the detected transient variation value is regarded as the correction value, and after the transient variation value reaches the peak value, a value obtained by decreasing the peak value at a certain time constant is regarded as the correction value, thus enabling correction of the temporary variations in air-fuel ratio during acceleration or deceleration.

Consequently, in an internal combustion engine with such an electronically controlled fuel injection system, the dispersion in the standing characteristics due to the tolerance in manufacture and problems of response during acceleration or deceleration in the use of the carburetor can be obviated. However, the necessity of providing fuel injection valves on respective cylinders leads to very high cost. Moreover, the dispersion between the respective fuel injection cylinders causes problems. Additionally, since liquid fuel is directly injected into the air intake system by means of the fuel injection valve, there is encountered a problem in that the atomization of fuel is not necessarily and satisfactorily effected.

In order to avoid the high cost involved with the above-mentioned electronically controlled fuel injection unit, there has been proposed such a system wherein a single fuel injection valve of large capacity is provided relatively upstream of the air intake system in place of the carburetor, so that the fuel injection flowrate can be electrically controlled. In this case, the flowrate of fuel which should be controlled by the single fuel injection valve becomes very large, thus causing a problem of difficulty in delicate control.

SUMMARY OF THE INVENTION

The present invention is intended to obviate the aforesaid shortcomings of the prior art, and one object thereof is to provide an air-fuel ratio control system in an internal combustion engine, wherein fuel can be atomized, excellent response provided, and delicate control effected, so that the air-fuel ratio can be correctly maintained within the given range.

Another object of the present invention is to provide an air-fuel ratio control system in an internal combustion engine, wherein all of the fuel flowrate control responding to the transient fluctuation in the operating conditions of the engine is effected by a fuel injection valve, and accordingly, necessity of providing a complicated correction device is eliminated, and the carburetor can be made simple and inexpensive.

A further object of the present invention is to provide an air-fuel ratio control system in an internal combustion engine, wherein, further, the air-fuel ratio can be correctly maintained within a given range even in transient operating conditions such as during acceleration and deceleration, warm-up operation of the engine and low atmospheric pressure.

According to the present invention, an air-fuel ratio control system in an internal combustion engine comprises a carburetor in which a basic air-fuel ratio is set on the lean side rather than at a controlled air-fuel ratio and fuel injection valves are provided for injecting a starved feed of fuel so that the air-fuel ratio can attain the controlled air-fuel ratio. A control circuit is provided for basically controlling the fuel flowrate injected from the fuel injection valves by the RPM of the engine and the air intake pressure, and for correcting and controlling the fuel flowrate according to the operating conditions of the engine during transient operating conditions, thereby achieving the aforesaid object.

Additionally, the basic air-fuel ratio set in the carburetor is substantially 18, so that the air-fuel ratio control during transient operating conditions, particularly during deceleration, can be reliably effected.

Further, the fuel injection valve is provided downstream of the throttle valve in the air intake system, thereby improving the response in air-fuel ratio control.

Furthermore, a transient operating condition occurs during acceleration or deceleration, and the operating conditions of the engine referred to in this case include the open-close speed of the throttle valve, air intake pressure, RPM and temperature of the engine, so that the air-fuel ratio control during acceleration or deceleration can be reliably effected.

In addition, a transient operating condition occurs during warm-up operation of the engine and the operating condition of the engine referred to in this case is the temperature of the engine, so that the air-fuel ratio control during warm-up operation of the engine can be reliably effected similarly to the above.

Further, a transient operating condition occurs during low atmospheric pressure, and the operating condition of the engine referred to in this case is the ambient atmospheric pressure, so that the air-fuel ratio control during low atmospheric pressure can be reliably effected similarly to the above.

DETAILED DESCRIPTION OF THE INVENTION

Figure 1:
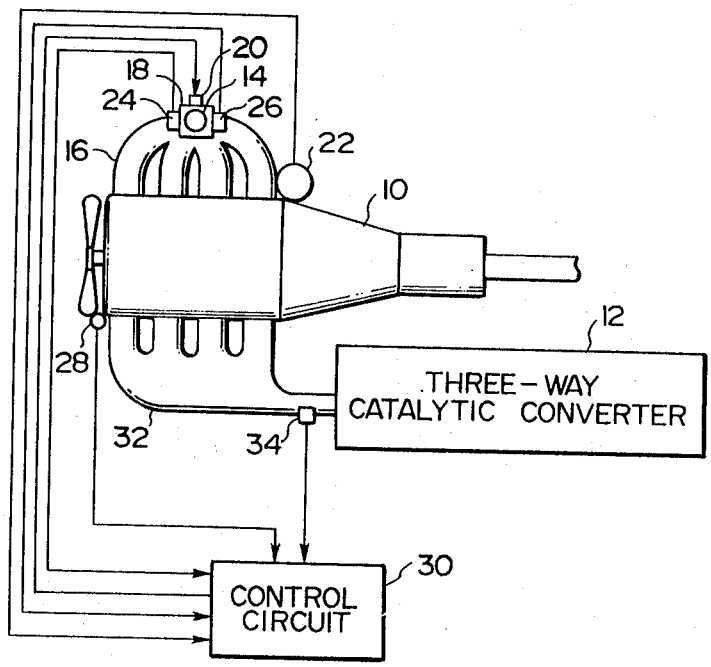
FIG. 1 is a block diagram showing the general construction of an emission control type engine of a motor car provided with the air-fuel ratio control system according to the present invention.

A detailed description will be given of one embodiment of the present invention with reference to the accompanying drawings. According to the present embodiment as shown in FIG. 1, an emission control type engine 10 has provided in the exhaust system thereof a three-way catalytic converter 12. The air-fuel ratio control system thereof comprises a carburetor 14 in which a basic air-fuel ratio is set on the lean side rather than at a controlled air-fuel ratio (i.e. the theoretical air-fuel ratio). In the present embodiment the basic air-fuel ratio of carburetor 14 is set at 18. A fuel injection valve 20 is provided on an intake pipe 18 connecting the carburetor 14 to an intake manifold 16 for injecting starved feed of fuel to the intake pipe 18, so that the air-fuel ratio can attain the controlled air-fuel ratio. A crankshaft angle sensor 22 is provided in an ignition distributor for generating an output each time the engine crankshaft rotates through 360°, i.e. one output per turn. An intake air pressure sensor 24 is provided similarly in the air intake pipe 18 for feeding an output signal for intake air pressure, and a throttle valve open-close speed sensor 26 is provided on the throttle valve of the carburetor 14 for detecting the open-close speed of the throttle valve and feeding an output signal therefor. An engine water temperature sensor 28 is provided for detecting the temperature of the engine from the temperature of engine cooling water and feeding an output therefor, and a control circuit 30 is provided for basically controlling the fuel flowrate injected from the fuel injection valve 20 commensurate to the RPM of the engine and the air intake pressure. The control circuit 30 also functions in correcting and controlling the fuel flowrate commensurate with the open-close speed of the throttle valve, the air intake pressure, the RPM of the engine and the engine water temperature during acceleration or deceleration. In FIG. 1, designated at 32 is an exhaust manifold, and 34 is an air-fuel ratio sensor provided downstream of the exhaust manifold 32 for feed-back controlling the fuel flowrate according to the actual air-fuel ratio.

Figure 2:
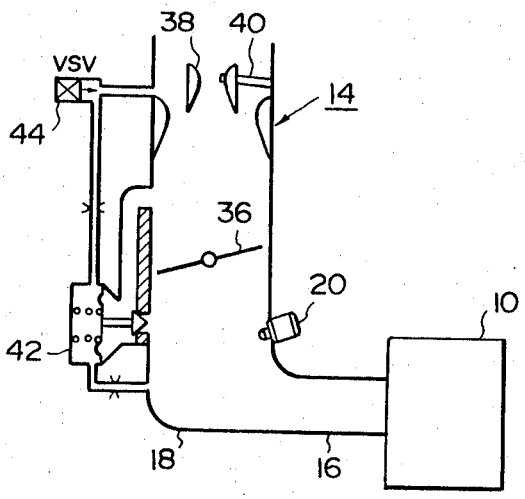
FIG. 2 is a cross-sectional view showing the position where the fuel injection valve is provided in the aforesaid embodiment.

The fuel injection valve 20 is, as shown in FIG. 2, provided downstream of a throttle valve 36 of the air intake pipe 18 connecting the carburetor 14 and the intake manifold 16. This location results in improved response due to the swirl injection resulting from the difference in pressure between before and after the throttle valve 36, as compared with the case where the fuel injection valve 20 is provided upstream of the throttle valve 36. Referring to FIG. 2, designated at 38 is a small venturi, 40 a main nozzle for feeding fuel into the small venturi 38, 42 a bypass valve for allowing an amount of air required for the continuation of idling to bypass the throttle valve 36 to be fed to the air intake pipe 18 during idling with the throttle valve 36 being fully closed, and 44 a negative pressure control valve for controlling the bypass valve 42.

As for carburetor 14, a simple single barrel type can be used having only slow and main systems and being free from complicated auxiliary control devices. Also, a carburetor of a simple variable venturi-flume type and being free from complicated auxiliary control devices can be used.

For the throttle valve open-close degree sensor 26, for example, an induction potentiometer is usable which can detect the opening degree of the throttle valve through a wide angle with high accuracy, and, moreover, has high durability. Alternatively, a Hall element and a combination of a resistance type potentiometer with a differentiation circuit are usable for the sensor 26.

Figure 3:
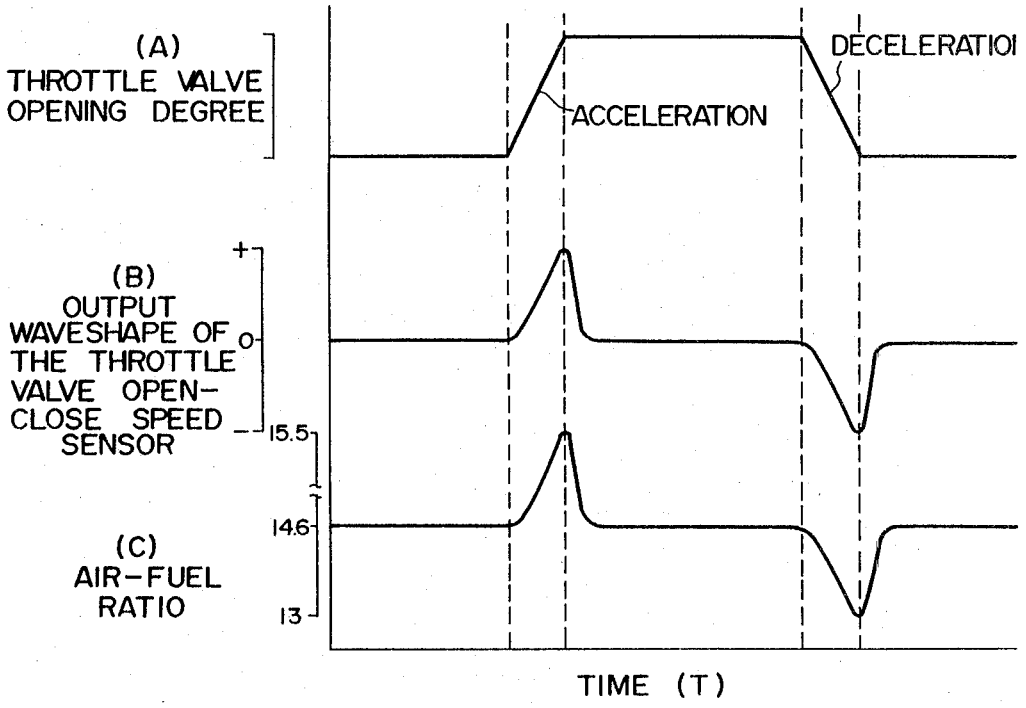
FIG. 3 is a diagram showing the relationship between the degree of throttle valve opening and the output from the throttle valve open-close speed sensor.

FIG. 3 shows the relationship between the throttle valve opening degree and the output waveshape of the throttle valve open-close speed sensor 26 during acceleration or deceleration in the throttle valve open-close speed sensor 26. In the drawing, designated at (A) is the throttle valve opening degree, (B) the output waveshape of the throttle valve open-close speed sensor 26, and (C) the changing progress of the air-fuel ratio in the case where the air-fuel ratio is not corrected during acceleration or deceleration.

Figure 4:
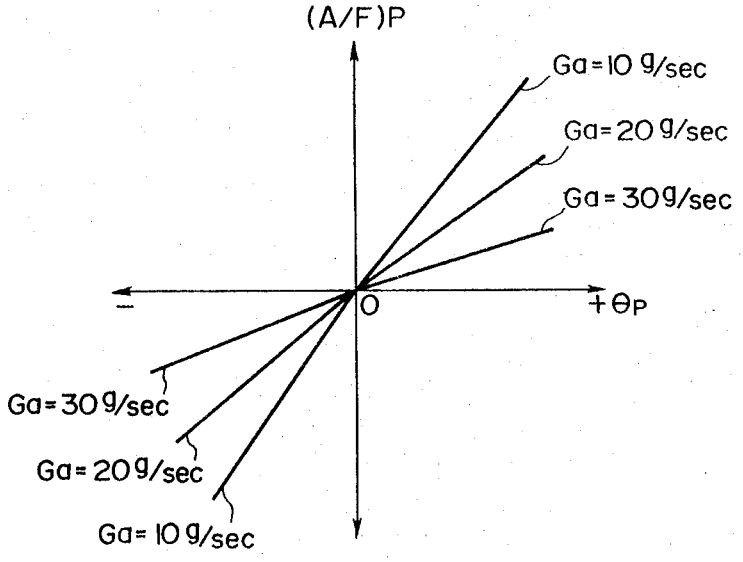
FIG. 4 is a diagram showing the relationship between the output peak value of the throttle valve open-close speed sensor and the peak value of the fluctuating air-fuel ratio.

FIG. 4 shows the relationship between the output peak value $\theta p$ of the throttle valve open-close speed sensor 26 and the fluctuating air-fuel ratio peak value (A/F)P with the intake air flowrate Ga being given as the parameter. As apparent from the drawing, there is a very good relationship between the output peak value of the throttle valve open-close speed sensor 26, the fluctuating air-fuel ratio peak value and the intake air flowrate.

Figure 5:
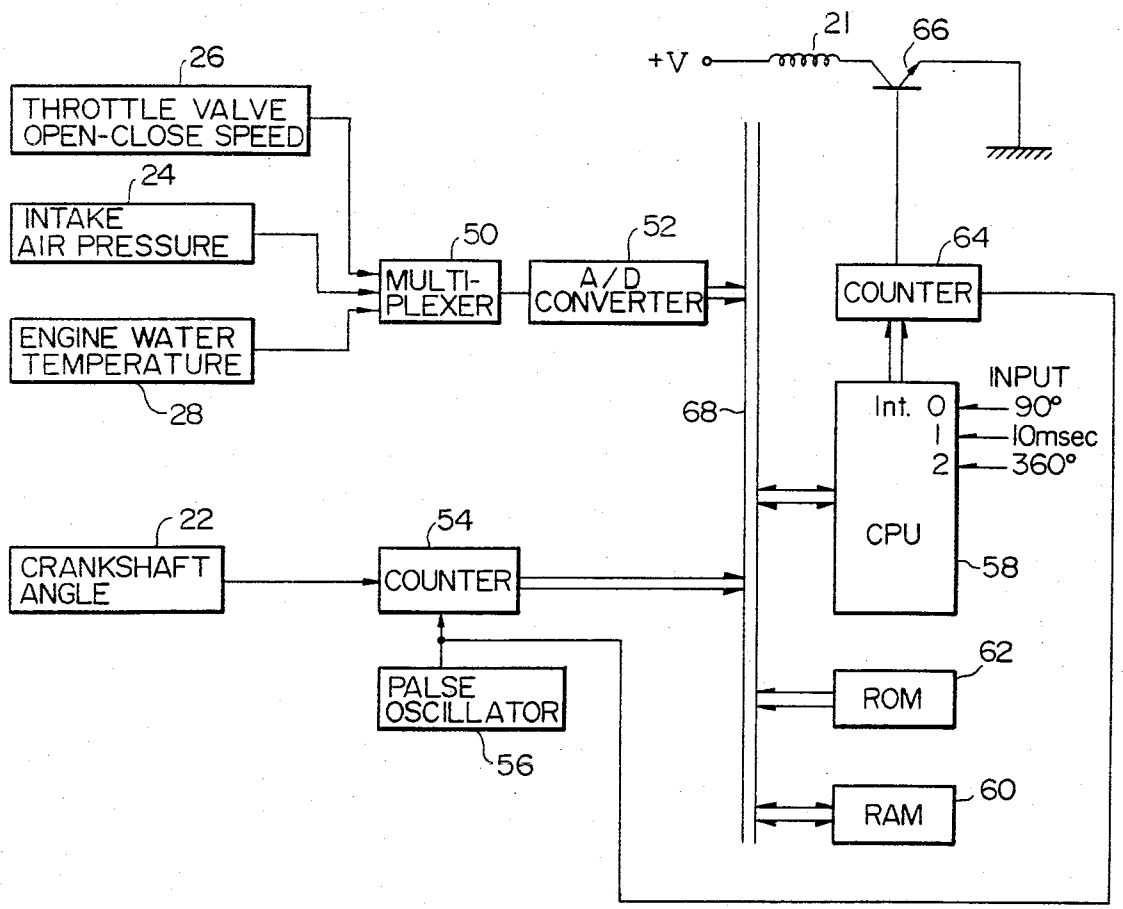
FIG. 5 is a block diagram showing the arrangement of a control circuit in the aforesaid embodiment.

As shown in FIG. 5, the control circuit 30 comprises a multiplexer 50 fed with an output from the throttle valve open-close speed sensor 26, an output from the intake air pressure sensor 24, and an output from the engine cooling water temperature sensor 28. An analog-digital converter 52 (hereinafter referred to as the "A/D converter") is provided for converting the output from the multiplexer 50 into a digital value. A first counter 54 is provided for counting the number of pulses generated by a pulse oscillator 56 per output generated by said crankshaft angle sensor 22, i.e. per turn of the crankshaft. A microcomputer 58 is used for performing the necessary calculation based on outputs from the analog-digital converter 52 and the first counter 54. A random access memory 60 (hereinafter referred to as the "RAM") is provided for provisionally storing constants and the like required for the operation in said microcomputer 58; and a read only memory 62 (hereinafter referred to as the "ROM") is used for storing programs and the like required for fuel injection. A second counter 64 is provided for counting the number of pulses generated by said pulse oscillator 56 per output generated by the microcomputer 58. A power transistor 66 is provided for on-off controlling the current flowing to an exciting coil 21 of the fuel injection valve 20 based on an output from the second counter 64, and a bus line 68 is used for connecting between said components.

Figure 6:
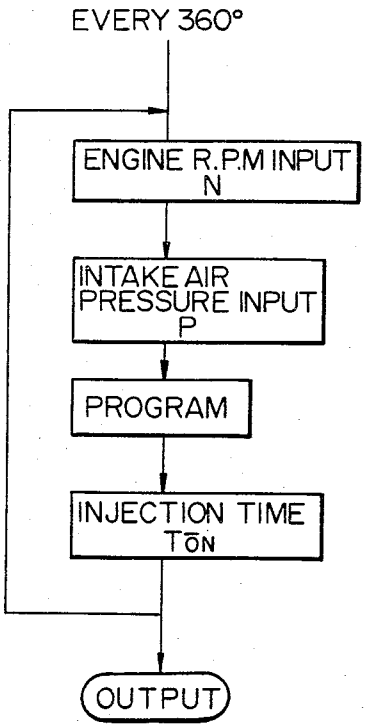
FIG. 6 is a flow chart showing the flow of processes of the main fuel injection control system in the aforesaid control circuit.
Figure 7:
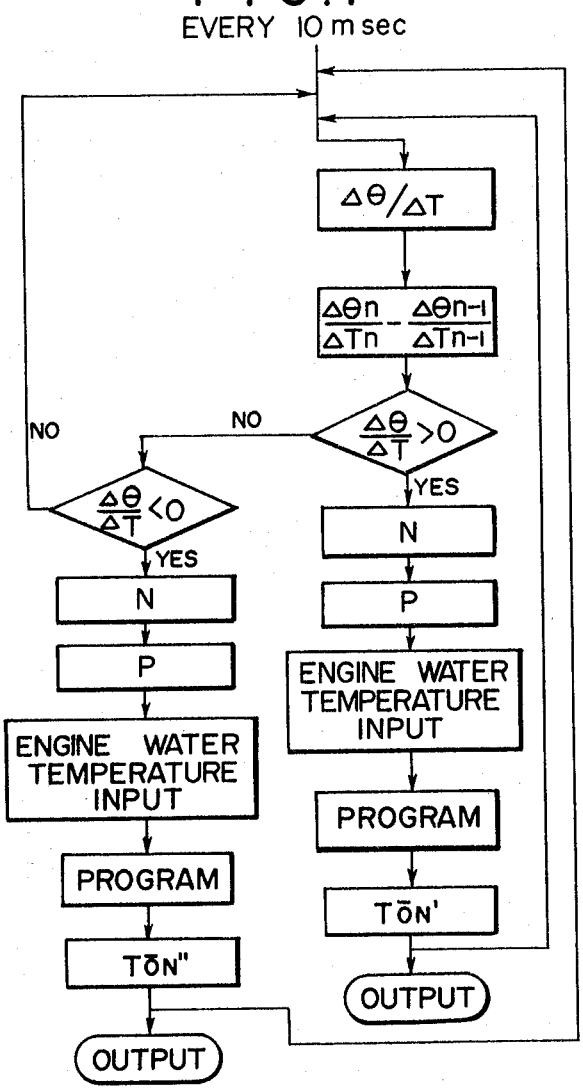
FIG. 7 is a flow chart showing the flow of processes of the acceleration-deceleration fuel increase-decrease system.

A description will now be given of the operation of the present invention. First, in normal operating conditions other than transient operating conditions, injection control over the main fuel is effected in accordance with the control process flow chart shown in FIG. 6. More specifically, since the air-fuel ratio of the fuel fed by the carburetor 14 is set on the lean side, i.e. is substantially 18, the opening time $T_{ON}$ of the fuel injection valve 20 is determined in accordance with the program previously stored by ROM 62 according to an engine RPM input N fed from the counter 54 and an intake air pressure input P fed from the intake air pressure sensor 24. Accordingly, the fuel injection valve 20 is controlled so that the air-fuel mixture fed to the engine can be program controlled to the theoretical air-fuel ratio. On the other hand, control during acceleration or deceleration, which is one of the transient conditions, is effected in accordance with the flow chart shown in FIG. 7. More specifically, output signals of throttle valve open-close speed sensor 26 are read every 10 milliseconds. The difference ($\Delta\theta/\Delta Y$) between the output of the throttle valve open-close speed sensor 26 at this time and the output of said throttle valve open-close speed sensor 10 milliseconds before is determined, and plus or minus of the result is determined. In case the difference ($\Delta\theta/\Delta Y$) is plus, an acceleration is indicated, and an air intake flowrate Ga is calculated from the engine RPM input and intake air pressure input which are also read every 10 milliseconds. Additionally, the engine water temperature is small in changing speed, and therefore, read only about every 1 sec. From the above-described data, the injection time $T_{ON}'$ is calculated from the following equation:

$$T_{ON}' = f(1/Ga) \cdot f(T_W) \cdot f(\Delta\theta/\Delta Y) \cdot K' \quad (1)$$

where K' is a constant determined by the configuration of the program.

The opening time $T_{ON}'$ of the fuel injection valve 20 is determined from the above-mentioned equation (1), and the injection flowrate is increased every 10 milliseconds.

On the other hand, in case the difference ($\Delta\theta/\Delta Y$) between the outputs of the throttle valve open-close speed sensor is minus, a deceleration is indicated, and similarly to the case of acceleration, the injection time $T_{ON}''$ is calculated from the following equation:

$$T_{ON}'' = f(1/Ga) \cdot f(T_W) \cdot f(\Delta\theta/\Delta Y) \cdot K'' \quad (2)$$

where K'' is a constant determined by the configuration of the program.

The opening time $T_{ON}''$ of the fuel injection valve during deceleration is determined from the above-mentioned equation, and the injection flowrate is decreased every 10 milliseconds.

Further, in case the difference ($\Delta\theta/\Delta Y$) between the outputs of the throttle valve open-close speed sensor is 0, the normal condition is indicated, and therefore, the opening time $T_{ON}$ of the fuel injection valve at the previous time is held.

Thus, the air-fuel ratio is held within the given range during acceleration as well as deceleration.

Figure 8:
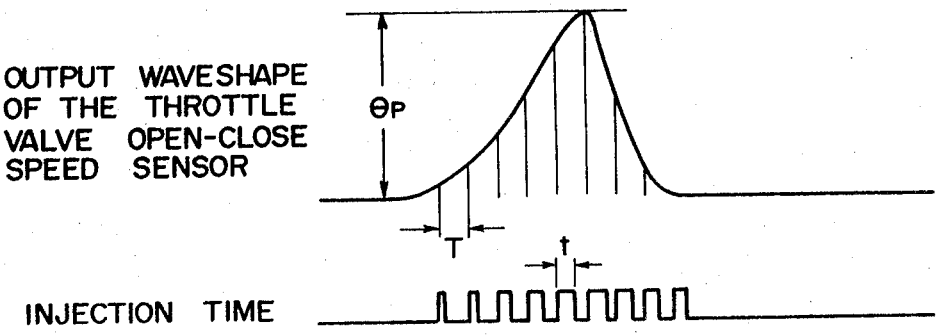
FIG. 8 is a diagram showing the relationship between the output from the throttle valve open-close speed sensor and the fuel injection time in the aforesaid embodiment.

FIG. 8 shows the relationship of the opening time t of the fuel injection valve with the throttle valve open-close speed sensor under the above-mentioned controlling condition. In the drawing, T is the sampling cycle time. As apparent from the drawing, the opening time of the fuel injection valve is commensurate to the output peak value Qp of the throttle valve open-close speed sensor.

In the present embodiment, an auxiliary fuel flowrate is controlled according to the throttle valve open-close speed signal, the air intake pipe negative pressure signal and the engine water temperature signal and an auxiliary fuel is delivered from the fuel injection valve. Hence, the fluctuation in air-fuel ratio during acceleration becomes very small. Furthermore, during deceleration, the air-fuel ratio is set on the lean side so that the air-fuel ratio of the fuel fed from the carburetor becomes substantially 18. Hence, the basic injection flowrate injected from the fuel injection valve, which is program controlled, is decreased by means of the signal source similar to the case of acceleration. Therefore, the fluctuation in air-fuel ratio can be easily made very small.

Figure 9:
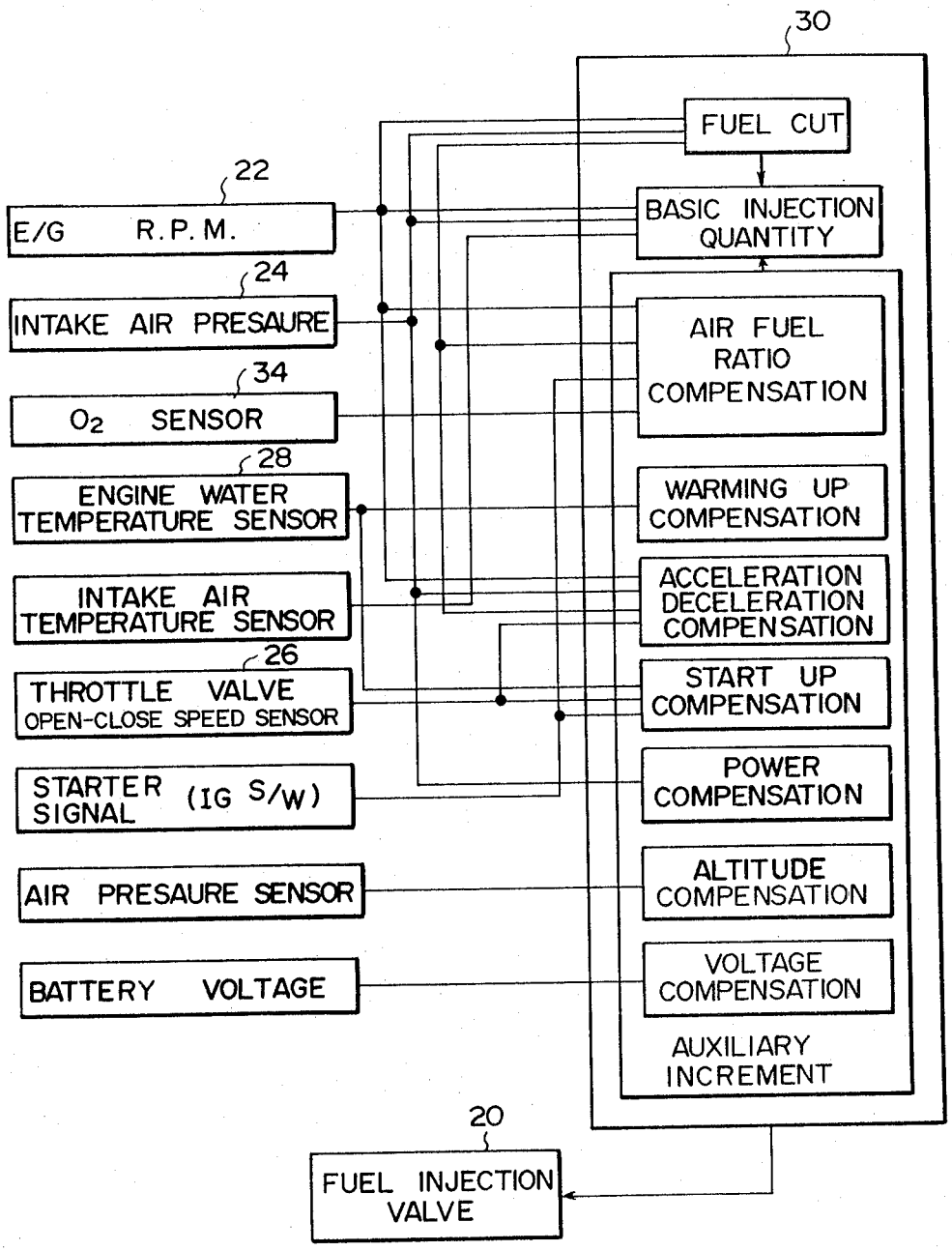
FIG. 9 is a block diagram showing one example of the integrated air-fuel ratio control system in the internal combustion engine embodying the present invention.

In addition, in the preceding embodiment, the fuel injection flowrate is supplementarily controlled for acceleration speed according to the throttle valve open-close speed, intake air pressure, engine RPM and engine temperature. However, the transient operating conditions where the fuel injection flowrate can be supplementarily controlled are not limited to the cases of acceleration and deceleration, and include, for example, such cases as starting and warm-up operation of the engine. In these situations the auxiliary fuel flowrate is increased or decreased detecting starter signal and temperature of the engine, thus enabling omitting a choke system. Also, the auxiliary fuel flowrate can be increased or decreased according to the ambient atmospheric pressure, i.e., during low atmospheric pressure. FIG. 9 shows one example of an integrated control system wherein the various operating conditions as described above are considered.

Although the invention has been described with reference to specific embodiments, it will be clear to those skilled in this art that various modifications or changes can be made without departing from the true spirit and scope of the invention.

What is claimed is:

1. An air-fuel ratio control system in an internal combustion engine comprising: a carburetor in which a basic air-fuel ratio is set on the lean side rather than at a controlled air-fuel ratio; a fuel injection valve for injecting feed of fuel so that the air-fuel ratio can attain a controlled air-fuel ratio; and a control circuit for basically controlling the fuel flowrate injected from said fuel injection valve according to RPM of the engine and an air intake pressure, and for correcting and controlling said fuel flowrate according to operating conditions of the engine during transient operating conditions, wherein said control circuit comprises: a multiplexer fed with an output from the throttle valve open-close speed sensor, an output from the intake air pressure sensor, and an output from the engine cooling water temperature sensor; an analog-digital converter for converting an output from said multiplexer into a digital value; a first counter, a pulse oscillator and a crankshaft angle sensor, said first counter counting the number of pulses generated by said pulse oscillator per output generated by said crankshaft angle sensor; a microcomputer for performing calculations based on outputs from said analog-digital converter and said first counter; a random access memory for provisionally storing constants and the like required for operation in said microcomputer; a read only memory for storing programs and the like required for fuel injection; a second counter for counting the number of pulses generated by said pulse oscillator per output generated by said microcomputer; a power transistor for on-off controlling the current flowing to an exciting coil of said fuel injection valve based on an output from said second counter; and a bus line for connecting between said components.

2. An air-fuel ratio control system in an internal combustion engine as set forth in claim 1, wherein the basic air-fuel ratio set in said carburetor is substantially 18.

3. An air-fuel ratio control system in an internal combustion engine as set forth in claim 1, wherein said carburetor is an elementary carburetor comprising a main metering system, float system, venturi and throttle valve.

4. An air-fuel ratio control system in an internal combustion engine as set forth in claim 1, wherein said fuel injection valve is disposed downstream of a throttle valve in an air intake system.

5. An air-fuel ratio control system in an internal combustion engine as set forth in claim 1, wherein said transient operating condition occurs during acceleration or deceleration and the operating conditions of the engine referred to include the open-close speed of the throttle valve, the air intake pressure, RPM, and the temperature of the engine.

6. An air-fuel ratio control system in an internal combustion engine as set forth in claim 1, wherein said transient operating condition occurs during warm-up operation of the engine and the operating condition of the engine referred to is the temperature of the engine.

7. An air-fuel ratio control system in an internal combustion engine as set forth in claim 1, wherein said transient operating condition occurs during low atmospheric pressure and the operating condition of the engine referred to is the ambient atmospheric pressure.

8. An air-fuel ratio control system in an internal combustion engine as set forth in claim 1, wherein said throttle valve open-close speed sensor is an induction potentiometer.

9. An air-fuel ratio control system in an internal combustion engine as set forth in claim 1, wherein said crankshaft angle sensor generates an output per revolution of the engine.

* * * * *